United States Patent [19]

Kato et al.

[11] 4,192,232

[45] Mar. 11, 1980

[54] ELECTROSTATIC IMAGE RECORDING METHOD AND APPARATUS THEREFOR

[75] Inventors: Hisashi Kato; Masakazu Iwasa; Yoshio Kudo, all of Tokyo, Japan

[73] Assignee: Fuji Photo Film Co., Ltd., Minami-ashigara, Japan

[21] Appl. No.: 886,448

[22] Filed: Mar. 14, 1978

[30] Foreign Application Priority Data

Mar. 14, 1977 [JP] Japan ..... 52/27756
Mar. 14, 1977 [JP] Japan ..... 52/27757

[51] Int. Cl.[2] ..... B41M 1/42

[52] U.S. Cl. ..... 101/426; 101/1; 101/DIG. 13; 346/153; 355/3 CH; 355/3 DR

[58] Field of Search ..... 101/1 R, 426, DIG. 13; 346/139 C, 153, 155; 355/3 R, 3 CH, 3 DR

[56] References Cited

U.S. PATENT DOCUMENTS

| | | | |
|---|---|---|---|
| 3,023,731 | 3/1962 | Schwertz | 101/DIG. 13 |
| 3,063,859 | 11/1962 | Heckscher | 101/DIG. 13 |
| 3,064,259 | 11/1962 | Schwertz | 101/DIG. 13 |
| 3,147,679 | 9/1964 | Schaffert | 101/DIG. 13 X |
| 3,178,718 | 4/1965 | Le Baron | 101/DIG. 13 |
| 3,182,591 | 5/1965 | Carlson | 101/DIG. 13 |
| 3,208,076 | 9/1965 | Mott | 101/DIG. 13 |
| 3,257,222 | 6/1966 | Carlson | 101/DIG. 13 |
| 3,358,289 | 12/1967 | Lee | 101/DIG. 13 |
| 3,460,156 | 8/1969 | Byrd | 101/DIG. 13 |
| 3,624,661 | 11/1971 | Shebanow | 101/DIG. 13 |

FOREIGN PATENT DOCUMENTS

| | | | |
|---|---|---|---|
| 971611 | 9/1964 | United Kingdom | 101/DIG. 13 |
| 1349342 | 4/1974 | United Kingdom | 101/DIG. 13 |

OTHER PUBLICATIONS

"Contact Electrostatic Printing", McCurry, IBM Tech. Discl. Bulletin, vol. 13, No. 10, 3/71, pp. 3117–3118.

*Primary Examiner*—S. H. Eickholt

[57] ABSTRACT

In an electrostatic image recording apparatus employing a series of recording styluses for forming a latent image on an electrostatic image recording drum, an over-discharge is conducted either by applying a very high voltage to the recording styluses or by first subjecting the drum to a pre-charge in one polarity and then forming the latent image on the drum by an over-discharge in the opposite polarity. Pre-charging of the drum enhances the effect of the subsequent discharging and permits over-discharge to be conducted with a lower voltage applied to the recording styluses than would otherwise be possible.

12 Claims, 11 Drawing Figures

ELECTROSTATIC IMAGE RECORDING METHOD AND APPARATUS THEREFOR

BACKGROUND OF THE INVENTION

1. Field of the Invention

This invention relates to an electrostatic image recording method and apparatus therefor, and more particularly to improvements in a method of forming an electrostatic latent image by use of a series of recording styluses and an apparatus for carrying out the method.

2. Description of the Prior Art

There is known an electrostatic image recording apparatus in which an electrostatic latent image is formed on an electrostatic image recording drum by use of a series of recording arranged in parallel to the axis of rotation of the drum along the surface thereof and the toner image developed from the latent image is finally transferred to a steel plate for printing thereon markings to indicate various kinds of information such as the destination of shipment, the dimensions of the steel plate, the date of manufacture etc. In this kind of apparatus, the size of the image is large and the diameter of the recording styluses is as large as 0.3 to 1.5 mm. Further, in order to prevent the toner particles not removed from the drum by the cleaning process from sticking to the recording styluses, there is provided a gap between the recording styluses and the surface of the electrostatic latent image recording drum. The discharge gap is as large as 30 to 150$\mu$.

In the above described apparatus, the latent image formed on the drum is a pattern consisting of a number of dots. Thus, the toner image developed therefrom is also a pattern consisting of dots. Since the speed of travel of the steel plates printed with markings by the above described print marking apparatus is fairly high and the developing time is short, the density of the central portion of the individual dots of the toner image is apt to be low.

SUMMARY OF THE INVENTION

In view of the above described problem, the primary object of the present invention is to provide a method of recording an electrostatic latent image on a latent image recording drum in which the dots of a latent image are recorded with high density.

Another object of the present invention is to provide a method of recording an electrostatic latent image on a latent image recording drum in which the dots of a latent image can be recorded with high density with a comparatively low voltage applied to the recording styluses.

Still another object of the present invention is to provide a method of recording an electrostatic latent image on a latent image recording drum at a high speed and with high density.

A further object of the present invention is to provide an electrostatic latent image recording apparatus in which a latent image is recorded at a high speed and with high density by use of a series of recording styluses.

The above objects of the present invention are accomplished by conducting an over-discharge by the discharge electrodes so that the individual dots of the latent image have peripheral protruding portions. By conducting over-discharge, a great amount of toner particles stick to the surface of the electrostatic latent image recording drum carrying the latent image and accordingly a toner image of high density can be obtained. The over-discharge can be conducted by applying a high voltage to the recording styluses. An applied voltage of as high as 2000 V is usually required to effect the over-discharge. As a result of the over-discharge, a toner image of high density and accordingly of high contrast can thereof be obtained.

In a preferred embodiment of the present invention, in order to facilitate the over-discharge, the electrostatic latent image recording drum is pre-charged before being subjected to the discharge by the recording styluses. The pre-charging is conducted to charge the surface of the drum in the opposite polarity to the polarity in which the drum is charged by the recording styluses. By the pre-charging, the drum is uniformly charged in the opposite polarity before the discharging by the recording styluses. Therefore, the effective discharging voltage can be raised by the level of the background potential. Hence, the voltage applied to the recording styluses can be lowered, which simplifies the structure of the drive circuit of the recording styluses and prevents discharge from occurring between adjacent discharge electrodes.

DETAILED DESCRIPTION OF THE INVENTION

The present invention will hereinbelow be described in detail with reference to the accompanying drawings.

Figure 1:
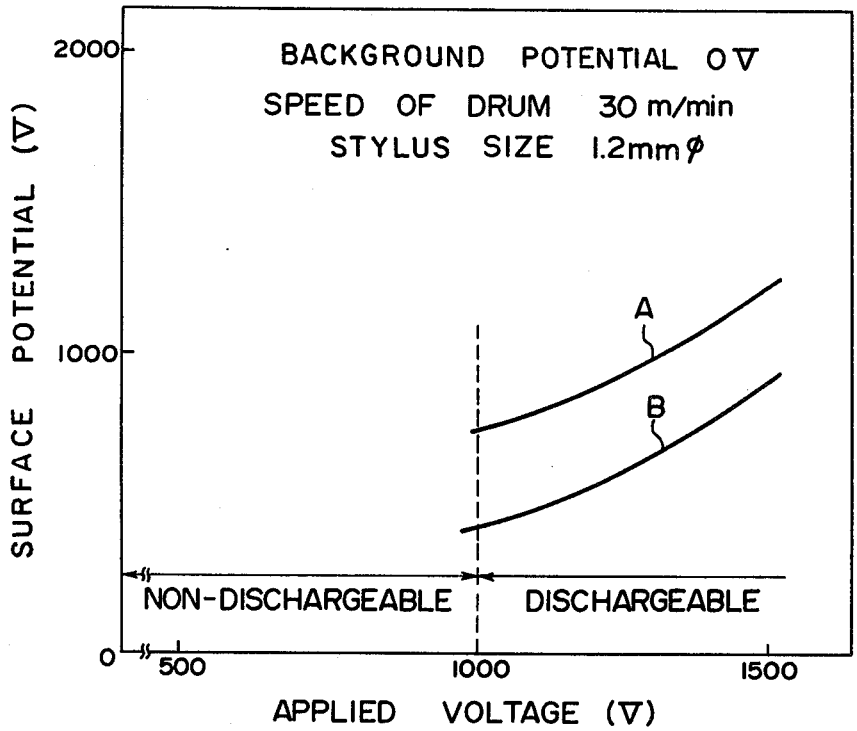
FIG. 1 is a graphical representation showing the relationship between the voltage applied to the discharge electrodes and the surface potential carried by the latent image formed by the discharge electrodes when the drum is not subjected to a pre-charge.

Referring to FIG. 1 which shows the relationship between the voltage applied to the recording styluses for recording the electrostatic image and the surface potential of the resulting charge carried by the electrostatic image recording drum, curve-A and curve-B are the characteristic curves showing the above relationship when the discharge gap is 30$\mu$ and 50$\mu$ respectively. As shown in FIG. 1, when the voltage applied to the recording styluses falls below 1000 V, no discharge occurs. Therefore, in order for discharge to occur between the styluses and the surface of the drum the styluses must be applied with a surface potential of at least 1000 V. Further, FIG. 1 shows that the surface potential conferred on the drum is lower when the discharge gap is larger. Therefore, when a large gap is formed between the styluses and the surface of the drum in order to reduce adherence of the toner particles to the styluses, a high voltage must be applied to the electrodes in order to obtain a latent image of high density.

Figure 2:
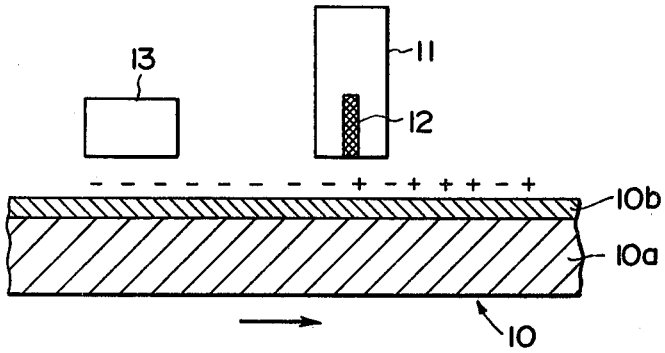
FIG. 2 is a side view showing the discharge electrode and a pre-charging charger employed in one embodiment of the present invention.

FIG. 2 shows the structure of the surface of an electrostatic latent image recording drum 10 and an stylus 11 provided with a recording stylus 12. A charger 13 for pre-charging the drum 10 is also shown in FIG. 2. The discharge gap between the tip of the stylus 11 and the surface of the drum 10 is set to be not more than 150μ. The gap is preferably set to be within the range of 80 to 100μ. The electrostatic latent image recording drum 10 has on its surface a dielectric layer **10*b* disposed on a metal body 10*a* so that the dielectric surface layer 10*b* is electrostatically charged by the discharge of the stylus 11. Before the surface layer 10*b* is charged by the stylus 11, it is uniformly charged in the opposite polarity by the pre-charging charger 13**.

A series of styluses 11 are arranged in the direction of the axis of rotation of the drum 10 at equal intervals of 2 mm. More exactly, a series of discharge electrodes 12 are arranged at a pitch of 2 mm, and accordingly the space between the adjacent styluses 11 is less than 2 mm. The recording styluses 12 are cylindrically shaped and have an appropriate diameter determined according to the kind of image to be formed thereby. When the diameter is too large, the central portion of the image dots is liable to have low or zero density. Accordingly, the diameter of the recording styluses 12 is 3 mm at maximum and is preferably 0.3 to 1.5 mm.

The background potential effected by the pre-charging is selected to be within the range of 300 to 1000 V, and more preferably 500 to 800 V. The voltage applied to the recording styluses 12 is selected to be within the range of 500 to 1500 V, and more preferably 900 to 1100 V. The polarity of the pre-charging is opposite to that of the charging by the recording styluses 12. Since the surface of the drum 10 is pre-charged in the opposite polarity before it is imagewisely charged, a better effect can be obtained with a lower applied voltage of the recording styluses.

Figure 3:
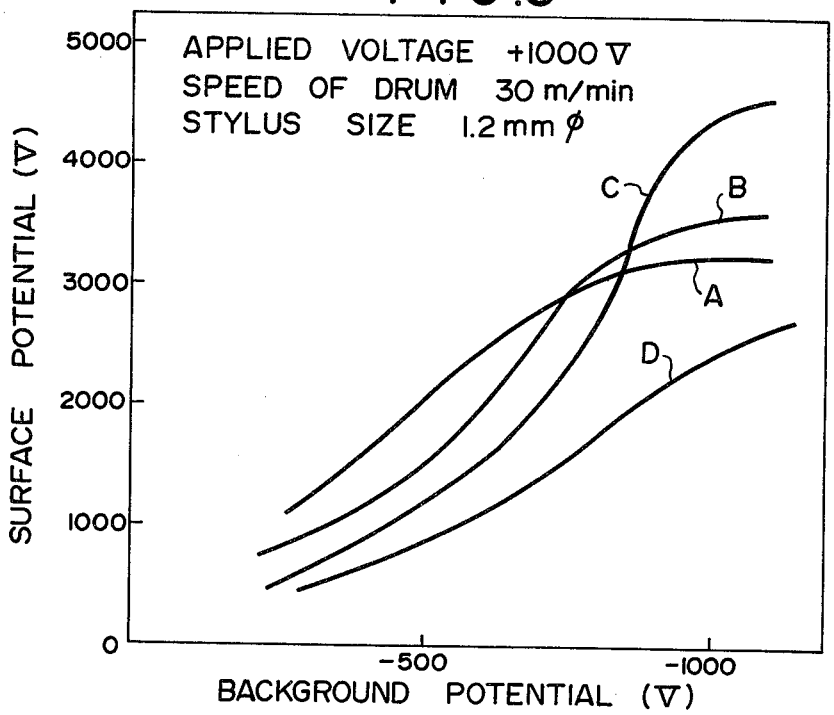
FIGS. 3 to 6 are graphical representations showing the relationship between the surface potential carried by the latent image formed by the recording styluses and other factors such as the voltage applied to the styluses, the background potential applied to the drum in the pre-charging step and the speed of rotation of the drum.

FIG. 3 shows the relationship between the surface potential carried by the latent image formed by the recording styluses and the background potential applied to the pre-charing charger. In the graphs of FIGS. 1 and 3 to 6, the conditions namely the potentials applied to the pre-charging charger and the recording styluses, the peripheral speed of the drum, the stylus size and the discharging gap, are indicated at the top thereof in terms of V(volts), meters per minute, millimeters and microns respectively. Referring to FIG. 3, the relationship is indicated for different discharge gaps with curve-A shows the results obtained for a discharge gap of 50μ, curve-B for 80μ, curve-C for 130μ and curve-D for 150μ. Since a good image can be obtained when the surface potential carried by the latent image is within the range of 500 to 3000 V, the results shown in FIG. 3 mean that a good image can be obtained when the background potential applied to the pre-charging charger is within the range of −300 to −1000 V under the condition that the recording styluses are applied with 1000 V. The most preferable background potential is −500 to −800 V.

Further, in comparing the results shown in FIG. 3 with the results in FIG. 1, it is obvious that the pre-charging has an effect not only of making it possible to lower the voltage applied to the recording styluses, but also of enhancing the charging effect. In other words, by employing the pre-charging step it is possible to charge the drum to higher voltage with the same discharging voltage effected between the styluses and the drum. For instance, under the conditions of the curve-A in FIG. 3, when the background potential is −500 V, the voltage of the charge is about 2000 V. The employment of a background potential of −500 V in the discharging step where the styluses are applied with +1000 V means that the effective discharging voltage is 1500 V. Under the conditions of curve-B in FIG. 1, when the discharging voltage is 1500 V, the surface potential is about 900 V. The curve-B in FIG. 1 is compared with the curve-A in FIG. 3 because these curves are for the same discharge gap of 50μ. The above comparison indicates that the pre-charging has a remarkable effect in enhancing the surface potential carried by the latent image. Since the electrostatic latent image can be recorded with such a high density as shown above when the pre-charging step is employed, the speed of the drum can be increased and the diameter of the recording styluses can be enlarged. Though it is normally understood that the surface potential is lowered as the discharging gap is increased, FIG. 3 shows that the surface potential is increased as the gap increases when the voltage applied to the pre-charger is higher than 800 V. This is true for the curves-A, -B and -C which are for gaps of 50μ, 80μ and 130μ respectively.

Figure 4:
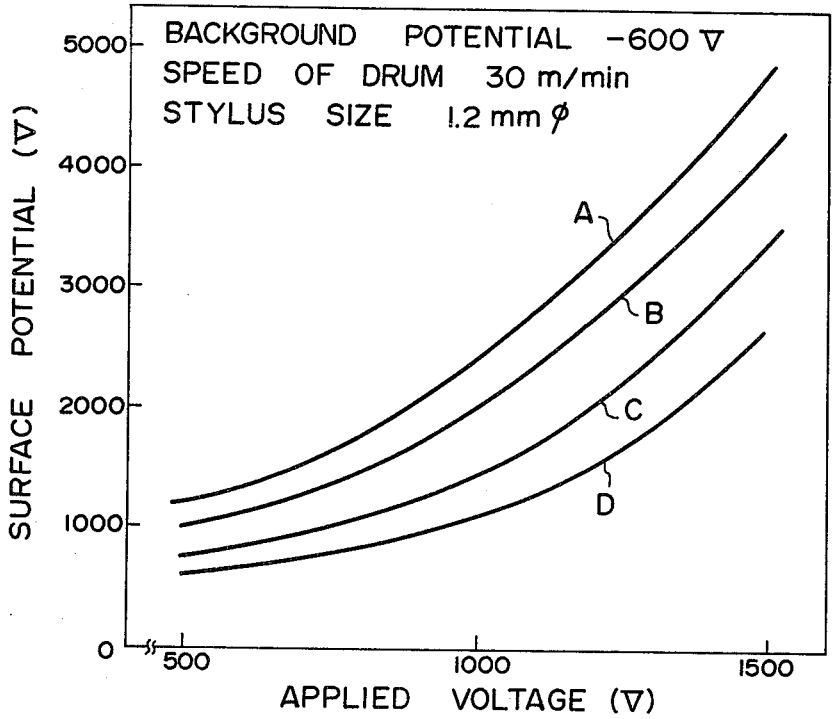

FIG. 4 shows results similar to those shown in FIG. 3 in which the voltage applied to the pre-charging charger (background potential) is set at −600 V and the voltage applied to the recording styluses is varied from 500 to 1500 V. The curves A to D are for the same discharging gaps as the curves A to D in FIG. 3. FIG. 4 indicates that, when the discharge gap is properly selected, the surface potential required to obtain a good image, that is a voltage between 500 and 3000 V, is obtained by applying a voltage of 500 to 1500 to the recording styluses.

Figure 5:
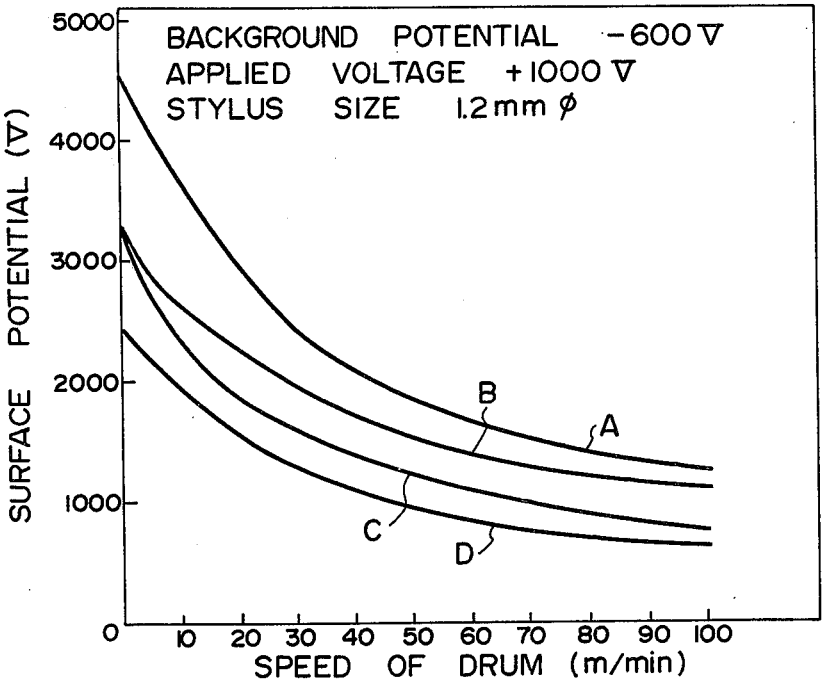

FIG. 5 shows the relationship between the voltage of the charge carried by the latent image and the speed of the drum. From FIG. 5 it is seen that under the conditions indicated in the graph the surface potential is maintained in the range of 600–1100 V which results in a good quality image even if the speed of the drum is increased up to as high as 100 m/min when the background potential is −600 V and the applied voltage is 1000 V. The curves A to D are for the same discharging gaps as the curves A to D in FIGS. 3 and 4.

Figure 6:
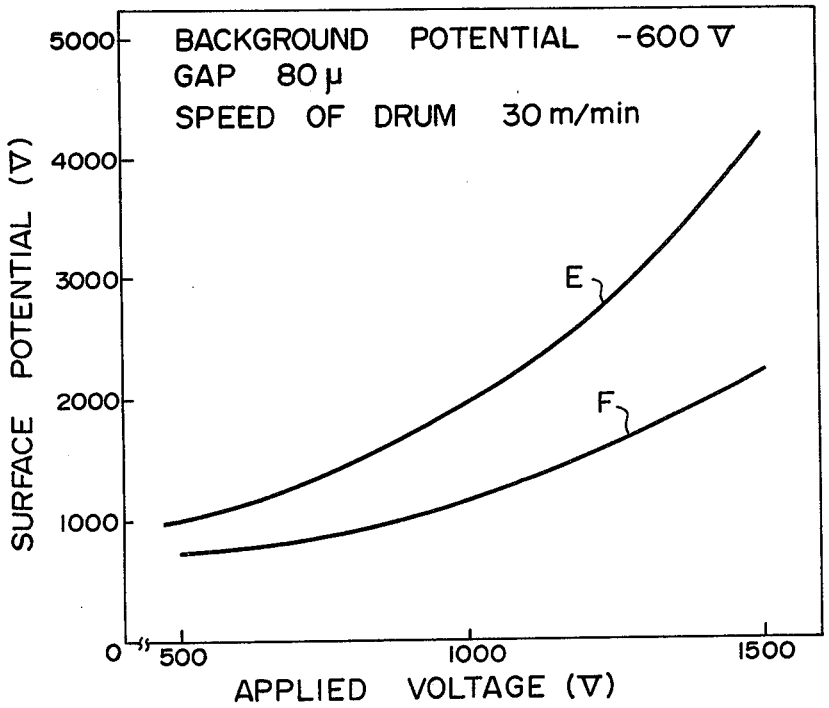

FIG. 6 shows the relationship between the surface potential carried by the latent image and the voltage applied to the recording styluses for styluses of different diameters. Curve-E shows the relationship when the diameter of the electrodes is 1.2 mm and curve-F shows the relationship when it is 3.0 mm. As shown in FIG. 6, the surface potential is lowered as the diameter of the styluses is increased. From FIG. 6, it is seen that the discharge is possible even if the diameter of the styluses is as large as 3.0 mm when the pre-charging is conducted at −600 V. Even when the discharge is conducted at a discharging voltage of as low as 500 V, the surface potential carried by the latent image thus formed is as high as 700 V.

Figure 9A:
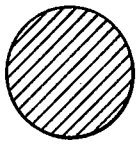
FIGS. 9A, 9B and 9C show the various shapes of the dots of the toner image developed from the electrostatic latent image formed by an electrostatic latent image recording apparatus.
Figure 9B:
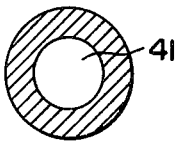

In accordance with the method as described hereinabove, a clear electrostatic latent image is obtained and a clear toner image is developed therefrom. The shape of the dots of the toner image thus obtained is shown in FIG. 9A. FIG. 9B shows the shape of the dots of the toner image developed from an electrostatic latent image recorded in accordance with the prior art in which the central portion of the dot has low or even zero density as shown at 41.

In accordance with the present invention, in order to obtain toner image dots having a uniform density throughout even when the time of development is shortened, the latent image is formed on the drum 10 by over-discharging. When the drum is not subjected to pre-charging, over-discharging occurs, for example, when the recording styluses are applied with a voltage of 1200 V or more, the speed of the drum 10 is 30 m/min, the diameter of the styluses is 1.2 mm and the discharge gap is 50$\mu$. When the drum is subjected to pre-charging at −500 V or more and the other conditions are the same, over-discharging occurs when the styluses are applied with a voltage of 900 V or more. As a result of over-discharging, the latent image formed on the drum 10 has a surface potential of 2000 V or more. When the voltage of the charge carried by the drum 10, namely the latent image, is 2000 V or more, the dots of the toner image have a shape as shown at 42 in FIG. 9C. The toner image dot 42 has a uniform circular body portion 42*a* surrounded by protruding portions 42*b*. When a toner image dot of the shape as shown in FIG. 9C is transferred to a transfer medium and finally to a steel plate, the toner image dot becomes as shown in FIG. 9A since the protruding portions 42*b* have a high voltage and are not transferred to the transfer medium.

Figure 7:
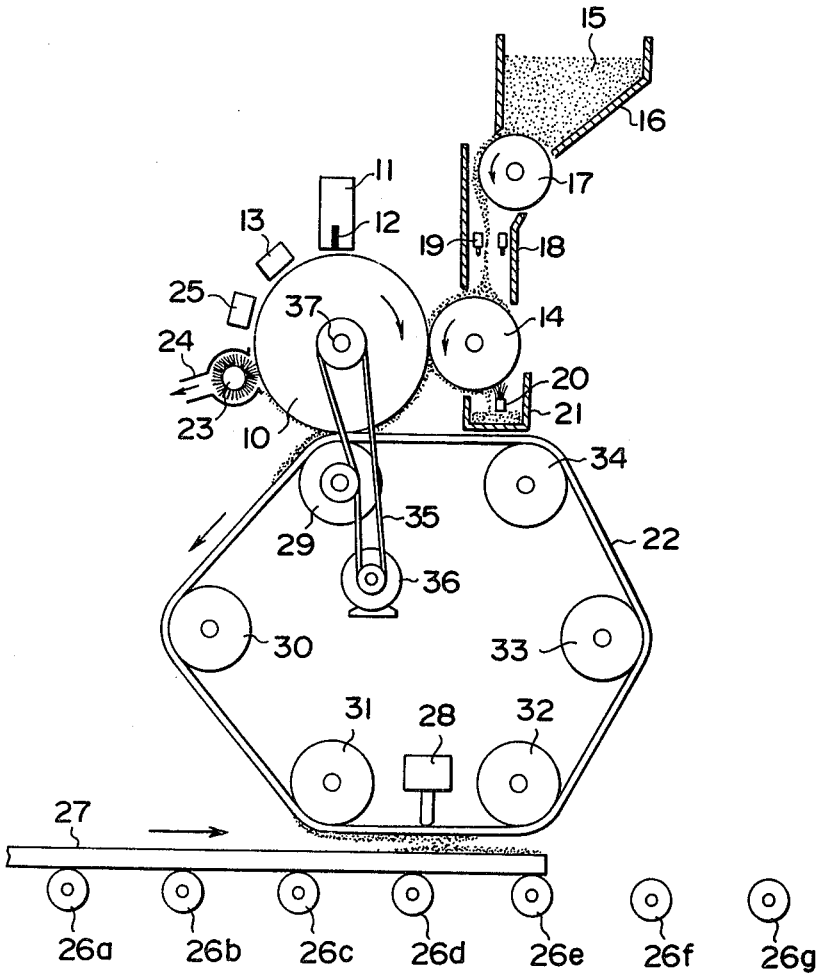
FIG. 7 is an elevational view showing an embodiment of the electrostatic latent image recording apparatus in accordance with the present invention.

Now, referring to FIGS. 7 and 8, an embodiment of the electrostatic print marking apparatus employing the electrostatic latent image recording apparatus in accordance with the present invention will be described in detail. An image recording drum 10 is used as an electrostatic image recording member for carrying an electrostatic latent image which is developed into a toner image and transferred to an intermediate image carrying medium, i.e. a transfer belt 22 described hereinafter. The image recording drum 10 is a metallic drum consisting of a metallic body 10*a* and a dielectric surface layer 10*b*, and may be replaced by a metallic belt carrying a dielectric surface layer thereon. The image recording drum 10 is uniformly pre-charged in advance by a DC charger 13. Then, the drum 10 is recorded with an electrostatic latent image by means of a set of styluses 11 having recording styluses 12 which charge the surface of the drum 10 in the opposite polarity to that of the polarity in which the drum 10 is uniformly pre-charged in advance. Since the drum 10 is pre-charged by the DC charger 13 in the opposite polarity to that of the electrostatic latent image, the effective surface potential of the latent image can be raised by the level of the background potential. Thus, the applied voltage of the recording styluses 12 can be set lower than would otherwise be possible. The drum 10 is pre-charged with a negative background potential and imagewisely charged with a positive voltage by the recording styluses 12.

The set of recording styluses 12 are arranged in a line parallel to the axis of rotation of the drum 10 at equal intervals and are supplied with discharging voltage in the form of pulses, whereby an electrostatic latent image is formed on the surface of the drum 10 in a pattern consisting of a number of image dots formed by over-discharging.

Figure 9C:
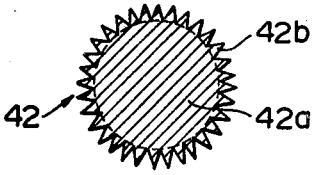

The electrostatic latent image thus formed is developed into a toner image formed of toner image dots like that shown in FIG. 9C by use of toner particles 15 carried by a developing roller 14. The toner particles 15 are retained in a hopper 16 and are fed out of the hopper 16 at a predetermined rate by means of a powder scattering roller 17 located beneath the open bottom of the hopper 16. The toner particles 15 fed out of the hopper 16 fall on the developing roller 14 through a guide duct 18. When the toner particles 15 fall through the guide duct 18, the toner particles 15 are charged in negative polarity by means of a pair of recording styluses 19. The residual toner particles 15 remaining on the surface of the developing roller 14 after the toner particles 15 on the developing roller 14 have been used for developing the electrostatic latent image are scraped off by a fixed brush 20 provided beneath the developing roller 14 in contact therewith and recovered in a container 21.

Under the image recording drum 10 is provided an intermediate image carrying medium in the form of a transfer belt 22. The toner image developed on the drum 10 is contact transferred to the transfer belt 22 and then is further transferred to a steel plate 27 by a gap transfer method. As the intermediate image carrying medium, there may be used a metallic drum or belt carrying a dielectric layer thereon. The transfer belt 22 employed in the embodiment of the invention as shown in the drawing is tensioned around six rollers 29 to 34 in the form of a hexagon. The first roller 29 is a driving roller which is driven by a motor 36 by way of a drive belt 35. Since the drive belt 35 is also tensioned around a pulley 37 of the recording drum 10, the transfer belt 35 and the recording drum 10 are rotated in synchronization with each other. Further, the pulleys are so selected that the peripheral speed of the drum 10 is equal to that of the transfer belt 22. The drum 10 and the belt 22 and other rollers are rotated when a steel plate 27 is fed to the print marking station on feed rollers 26*a* to 26*g*. Arrival of teh steel plate 32 at the print marking station is detected by a detecting means. Further, the transfer belt 22 is driven at the same speed as that at which the steel plate 27 is fed so that the surface of the transfer belt 22 carrying a toner image to be transferred to the steel plate 32 runs in parallel to and at the same speed as that of the surface of the steel plate 27.

The second roller 30 is a tension roller which is spring biased outwardly by means of a spring (not shown) to provide the transfer belt 22 with a constant tension. The third and fourth rollers 31 and 32 are movable up and down by means of a drive means (not shown) so that these rollers 31 and 32 move the transfer belt 22 close to the steel plate 27 only when the steel plate 27 passes thereunder and hold the same in an upper position when the steel plate 27 is not present at to the print marking station.

The toner image transferred to the transfer belt 22 is gap-transferred to the steel plate 27 at the transfer station between the third and fourth rollers 31 and 32. In the course of the gap transfer, a part of the transfer belt 22 is imparted with an ultrasonic vibration from an ultrasonic vibrator 28. At the same time, a high voltage of about 8 to 10 KV is applied across the space between the transfer belt 22 and the steel plate 27 in the transfer station.

The toner particles remaining on the surface of the recording drum 10 after the toner image is transferred to the transfer belt 22 are removed by a rotary brush 23. The rotary brush 23 is provided within a casing 24 connected with a suction means so that the toner particles removed from the surface of the drum 10 by the brush 23 is sucked and restored through the casing 24. The electric charge carried by the recording drum 10 is then neutralized by an AC charger 25.

Figure 8:
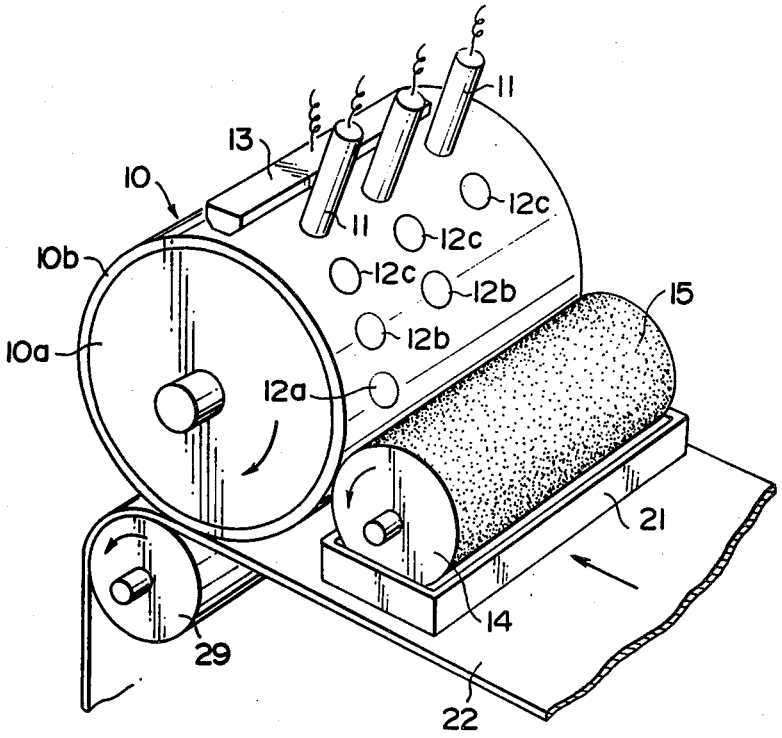
FIG. 8 is a perspective view showing the arrangement of the recording styluses and the drum employed in the present invention.

In operation of the above described embodiment of the present invention, the surface of the recording drum 10 is pre-charged by the DC charger 13 and then is charged imagewise by over-discharging by the set of recording styluses 12 in the form of a dotted pattern consisting of a number of dots 12*a*, 12*b*, 12*c* as shown in FIG. 8. Thus, an electrostatic latent image is formed on the surface of the image recording drum 10.

On the other hand, the toner particles 15 fed out of the hopper 16 are charged in negative polarity by the pair of recording styluses 19 while the toner particles 15 fall through the guide duct 18. The charged toner particles 15 fall on the developing roller 14. As the developing roller 14 rotates, the toner particles 15 thereon are brought into contact with the surface layer 10*b* of the image recording drum 10 which carries the electrostatic latent image and are transferred to the surface of the drum 10. The remaining toner particles are removed from the surface of the developing roller 14 by the fixed brush 20 and recovered in a container 21.

The electrostatic latent image is thus developed into a toner image and is then transferred to the transfer belt 22 by a contact transfer method. A high voltage of about 2 KV is applied across the drum 10 and the belt 22 when the toner image is transferred from the drum 10 to the belt 22. The transfer belt 22 is rotated in synchronization with the steel plate 27 fed to the print marking station on the feed rollers 26*a* to 26*g*. As the transfer belt 22 runs along the path around the six rollers 29 to 34, the toner image advances from a transfer station where the toner image is transferred from the drum 10 to the belt 22 to the print marking transfer station where the toner image is transferred from the belt 22 to the steel plate 27. The toner image is then transferred from the belt 22 to the steel plate 27 when the toner image passes through the print marking transfer station between the third and fourth rollers 31 and 32. This transfer is a gap transfer conducted with the aid of vibration caused by the ultrasonic vibrator 28 and a high voltage applied across the space between the belt 22 and the steel plate 27. The transfer belt 22 is applied with a voltage at the print marking station of opposite polarity to the voltage applied thereto at the transfer station where the toner image is transferred from the image recording drum 10 to the transfer belt 22. Since the level of the voltage applied at the print marking station is high, the belt 22 is separated from the drum 10 while the toner image is transferred to the steel plate 27.

After the toner image has been transferred from the image recording drum 10 to the belt 22, the surface of the recording drum 10 is cleaned by the rotary brush 23 to remove the residual toner particles remaining on the surface of the recording drum 10. The surface charge carried by the drum 10 is then neutralized by the AC charger 25. Thus, one cycle of the print marking process is finished.

We claim:

1. An electrostatic latent image recording method in an electrostatic image recording apparatus in which an electrostatic latent image is formed on an electrostatic latent image recording surface by use of a plurality of recording styluses having a diameter of 0.3 mm to 3 mm wherein the improvement comprises a step of causing an over-discharge to occur between the recording styluses and said latent image recording surface while maintaining a spacing of 30μ to 150μ therebetween.

2. An electrostatic latent image recording method as claimed in claim 1 wherein said over-discharge is conducted so that the electrostatic latent image recorded on the latent image recording surface has an electrostatic voltage of 2000 V or more.

3. An electrostatic latent image recording method as claimed in claim 1 wherein said over-discharge is conducted by applying a voltage of 1200 V or more to said discharge electrodes, the discharge gap between said discharge electrodes and said latent image recording surface being 50μ, and the speed of the latent image recording surface with respect to said discharge electrodes being 30 m/min.

4. An electrostatic latent image recording method as claimed in claim 1 further comprising a step of pre-charging said latent image recording surface before the latent image is formed thereon, the pre-charging step charging the surface into the opposite polarity to that in which the surface is charged in said over-discharge step.

5. An electrostatic latent image recording method as claimed in claim 4 wherein said pre-charging is conducted to give the latent image recording surface an electrostatic voltage of 500 V or more.

6. An electrostatic latent image recording method as claimed in claim 5 wherein said pre-charging is conducted before the latent image recording surface is subjected to said over-discharge conducted by use of discharge electrodes having a diameter of 1.2 mm located in the vicinity of the latent image recording surface running at a speed of 30 m/min with respect to said discharge electrodes with a discharging gap of 50μ.

7. An electrostatic latent image recording method as claimed in claim 6 wherein said over-discharge is conducted by applying a voltage of 900 V or more to said discharge electrodes.

8. An electrostatic latent image recording method as claimed in claim 1 wherein said spacing between the recording system and the latent image recording surface is maintained to be 80μ to 100μ.

9. An electrostatic latent image recording apparatus adapted to be used in an electrostatic print marking apparatus for printing markings on a steel plate or the like, said latent image recording apparatus comprising an electrostatic latent image recording medium having a dielectric surface layer, and a set of recording styluses having a diameter of 0.3 mm to 3 mm arranged in a series along the surface of said surface layer with a discharging gap of 30μ to 150μ in the direction perpendicular to the direction in which the latent image recording medium is moved, wherein the improvement comprises means for applying to said recording styluses a voltage which is high enough to cause an over-discharge between the recording styluses and the surface layer of the latent image recording medium.

10. An electrostatic latent image recording apparatus as claimed in claim 8 wherein said means for applying a voltage to the discharge electrodes is capable of applying a voltage of 2000 V or more to the discharge electrodes.

11. An electrostatic latent image recording apparatus as claimed in claim 8 further comprising a pre-charging means provided upstream said discharging electrodes for charging the surface layer of said latent image recording medium in the polarity opposite to the polarity in which the surface layer is charged by said discharge electrodes.

12. An electrostatic latent image recording apparatus as claimed in claim 11 wherein said pre-charging means is capable of applying a voltage of 300 to 1200 V to the surface layer.

* * * * *